US007247236B2

(12) United States Patent
Desjoyaux et al.

(10) Patent No.: US 7,247,236 B2
(45) Date of Patent: Jul. 24, 2007

(54) PIPE-CONNECTING DEVICE

(75) Inventors: Jean-Louis Desjoyaux, Chalain le Comtal (FR); Pierre-Louis Desjoyaux, La Fouillouse (FR); Catherine Jandros, L'Etrat (FR)

(73) Assignee: Piscines Desjoyaux SA, La Fouillouse (FR)

( * ) Notice: Subject to any disclaimer, the term of this patent is extended or adjusted under 35 U.S.C. 154(b) by 13 days.

(21) Appl. No.: 10/544,295

(22) PCT Filed: Feb. 5, 2004

(86) PCT No.: PCT/FR2004/000267

§ 371 (c)(1),
(2), (4) Date: Aug. 3, 2005

(87) PCT Pub. No.: WO2004/072412

PCT Pub. Date: Aug. 26, 2004

(65) Prior Publication Data

US 2006/0151370 A1 Jul. 13, 2006

(30) Foreign Application Priority Data

Feb. 6, 2003 (FR) ..... 03 01568

(51) Int. Cl.

| | |
|---|---|
| ***B01D 35/02*** | (2006.01) |
| ***B01D 35/027*** | (2006.01) |
| ***B01D 35/26*** | (2006.01) |
| ***E04H 4/12*** | (2006.01) |
| ***E04H 4/14*** | (2006.01) |

(52) U.S. Cl. ..... 210/232; 21/167.1; 21/167.15; 21/416.2

(58) Field of Classification Search ..... 210/232, 210/169, 416.2, 167.1, 167.15
See application file for complete search history.

(56) References Cited

U.S. PATENT DOCUMENTS

| | | | | |
|---|---|---|---|---|
| 4,645,593 A | | 2/1987 | Dunk et al. | 210/169 |
| 5,879,547 A | * | 3/1999 | Desjoyaux et al. | 210/169 |
| 6,138,294 A | * | 10/2000 | Desjoyaux et al. | 4/509 |

FOREIGN PATENT DOCUMENTS

| | | |
|---|---|---|
| DE | 87 00 090 U | 2/1987 |
| FR | 2 831 581 | 5/2003 |

* cited by examiner

*Primary Examiner*—Thomas M. Lithgow
(74) *Attorney, Agent, or Firm*—Heslin Rothenberg Farley & Mesiti P.C.

(57) ABSTRACT

A device is provided for connecting pipe parts between two compartments of a filtration unit for water of a swimming pool. The filtration unit has a filtration compartment submerged in the water and equipped with at least one filtration means and a pumping compartment situated outside of the swimming pool and equipped with at least one suction and return pump. The compartments are connected by a common part that straddles the walls of the swimming pool. The filtration means and pump or pumps are connected in combination with suction and return pipe parts, which have one part situated in the filtration compartment and one part situated in the pumping compartment. At the common connecting part, watertight connecting members are positioned between the suction and return pipe conduit parts, whose thickness is less than the diameter of the various pipe parts.

6 Claims, 5 Drawing Sheets

PIPE-CONNECTING DEVICE

CROSS REFERENCE TO RELATED APPLICATIONS

This application is a 371 filing of PCT International application no. PCT/FR2004/000267 filed Feb. 5, 2004 and published in French as WO 2004/072412 A1 on Aug. 26, 2004 which claims priority of French application no. 03.01568 filed Feb. 6, 2003, the disclosures of which are hereby incorporated by reference in their entirety.

BACKGROUND OF THE INVENTION

The invention relates to the technical field of filtration systems for swimming pools.

More specifically, the invention relates to the compact water filtration units used in swimming pools. These units comprise, in a known way, a "filtration" compartment and a "pumping" compartment. The filtration compartment is designed to be submerged in the water of the swimming pool. This compartment houses one or more filtration means of any appropriate known type. The pumping compartment is situated on the outside of the swimming pool. It is usually buried, and has one or more pumps for sucking the water in and returning it, as indicated in the rest of this description. The pumping and filtration compartments are connected by a common part which usually straddles the walls of the swimming pool, whatever its specific design. This part of the overall filtration unit has the shape, very approximately, of an upside-down staple. Examples of this type of filtration unit can be found in the teachings of patents FR 97.01642, FR 98.03790 and FR 99.12856.

In essence, the filtration means, whatever its particular design, is connected, by pipe elements, to the pump or pumps installed in the pumping compartment. More particularly, these pipe elements are connected to the suction intake of the pump. Other pipe elements are connected to the pump's return outlet where the filtered water is returned to the swimming pool by means of for example nozzles on a part of the filtration compartment.

Clearly, the suction and return pipe systems are made up of several elements connected by elbows or the like to form the connection between the filtration compartment and the suction compartment. For reasons of ease of installation and to keep costs down, these pipe elements are of round section and advantageously made of PVC, conforming with standard components as widely available in the trade. Specifically, the use of this kind of round-section pipe element keeps costs down and enables different types of connection to be made.

Because of the need to make a circuit to carry the water between the filtration compartment and pumping compartment, the suction and return pipes are also present in the common connecting part between the two compartments. In this area the suction and return pipes are usually placed side by side in a horizontal plane.

As a result, these round-section pipes occupy a certain height, so that the common connecting part appears above the edge of the swimming pool. The same is also true of the filtration and pumping compartments.

In other words, the filtration unit as a whole, in the prior art, must project high enough to allow the suction and return pipes to pass across. This excess height is not always very appealing to the eye and can interfere with the integration of the complete filtration unit in the coping and areas around the pool.

SUMMARY OF THE INVENTION

It is an object of the invention to solve these problems in a simple, safe, effective and efficient manner.

The problem which the invention seeks to solve is how to minimize the height of the connecting part between the filtration and pumping compartments, in such a way that the filtration unit as a whole hardly shows above the surrounding areas for example, while not increasing production costs, in other words keeping open the possibility of making the suction and return circuits largely from round-section pipe elements of the type commonly used in the trade.

To solve this kind of problem, a device for connecting suction and return pipes, particularly between two compartments of a filtration unit, has been designed and developed, the said device comprising a module of thin flat cross section defining at least one open-ended internal conduit, the said conduit or conduits having members for watertight connection with flat-section connectors, the said connectors being fixed to the suction and return pipes, and the said module being arranged between the two compartments, at the common linking part.

Advantageously, in response to the problem of how to separate the suction and return circuits, the module defines, in section, two separate internal conduits, each conduit having the members for connection to the flat-section connectors, for the connection to the suction and return pipes positioned in the filtration and pumping compartments.

To solve the problem of how to connect the module as a whole to the suction and return pipes, the connecting members of the module are flat, especially rectangular, section adaptors in communication with the conduits.

Advantageously, the flat-section connectors are made integral, directly or by being connected, with round-section adaptors able to be connected by watertight engagement with the pipe elements of complementary section.

To solve the problem of how to facilitate the installing and connection of the various suction and return pipes, without increasing costs, the module is an independent add-on element fixed in a watertight manner to the common connecting part, between the two compartments.

Advantageously, the module has in section a profile able to fit in a complementary profile serving as a bearing cradle formed in the thickness of the common connecting part.

In one particular embodiment of the whole filtration unit, the module and the two compartments are connected together by a common linking frame fitted with covers for closing each of the said compartments.

BRIEF SUMMARY OF THE VARIOUS VIEWS OF THE DRAWINGS

The invention is set out below in greater detail with the aid of the figures of the attached drawings, in which.

DETAILED DESCRIPTION

Figure 1:
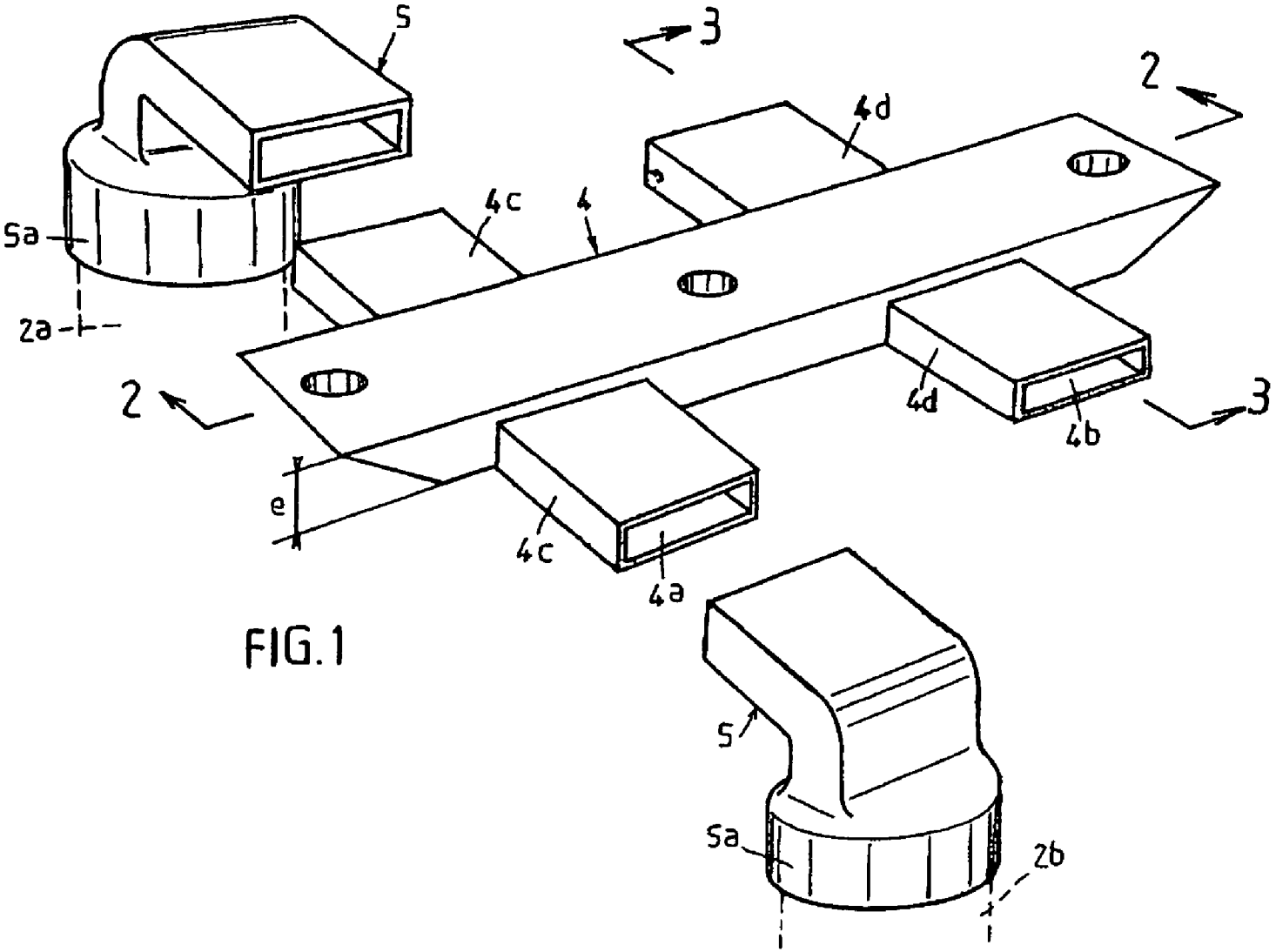
FIG. 1 is a perspective view of all the elements of the connection device.
Figure 2:
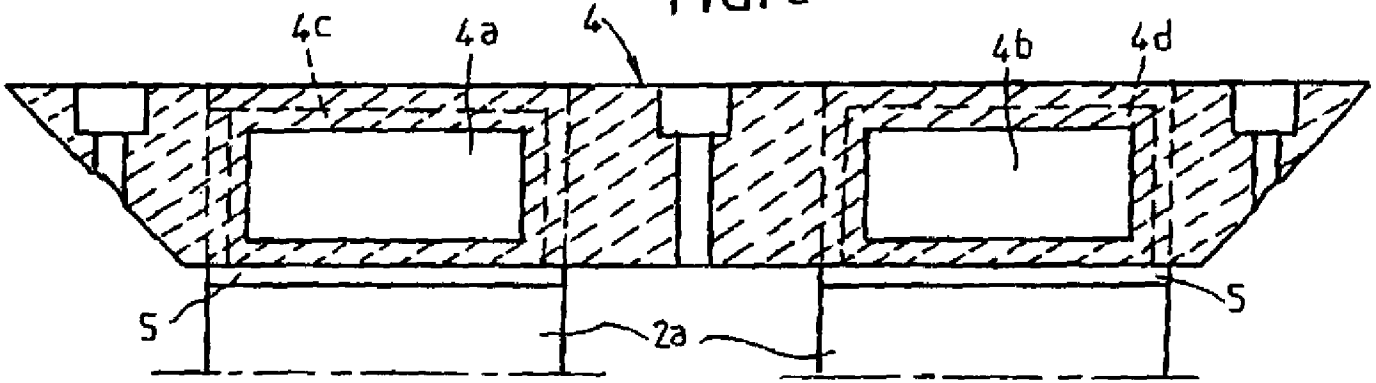
FIG. 2 is a transverse cross section on the plane marked 2-2 in FIG. 1.
Figure 3:
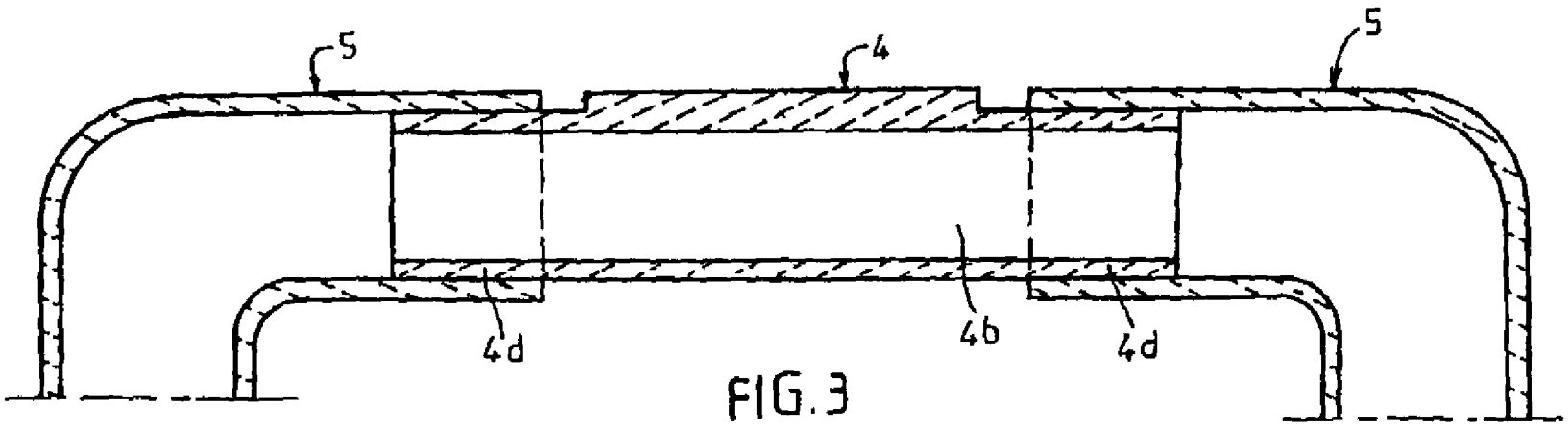
FIG. 3 is a cross section on the plane marked 3-3 in FIG. 1, following connection of the corresponding pipe parts.
Figure 4:
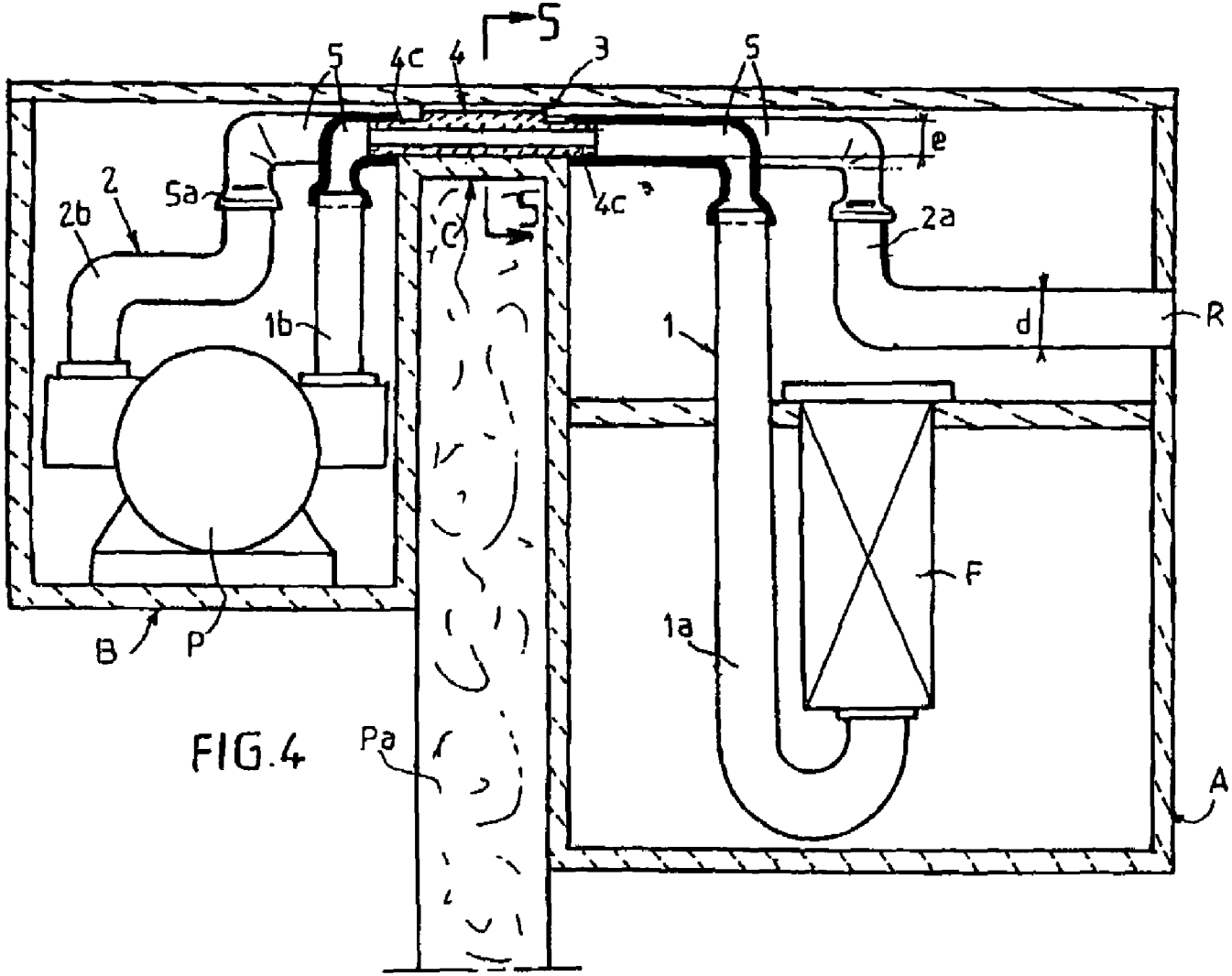
FIG. 4 is a longitudinal cross section through an example of an embodiment of a compact filtration unit equipped with the device.
Figure 5:
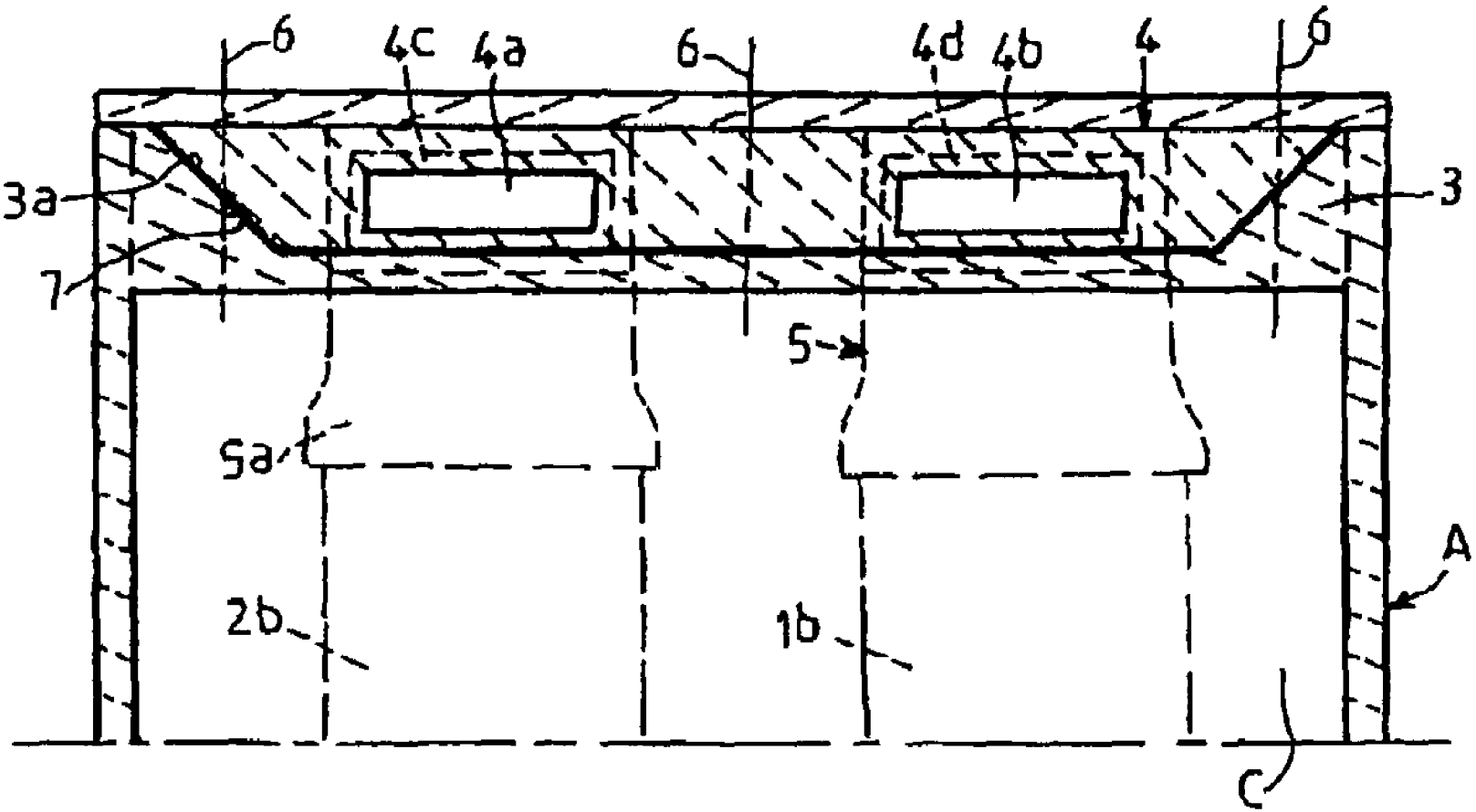
FIG. 5 is a transverse cross section on the plane marked 5-5 in FIG. 4.
Figure 6:
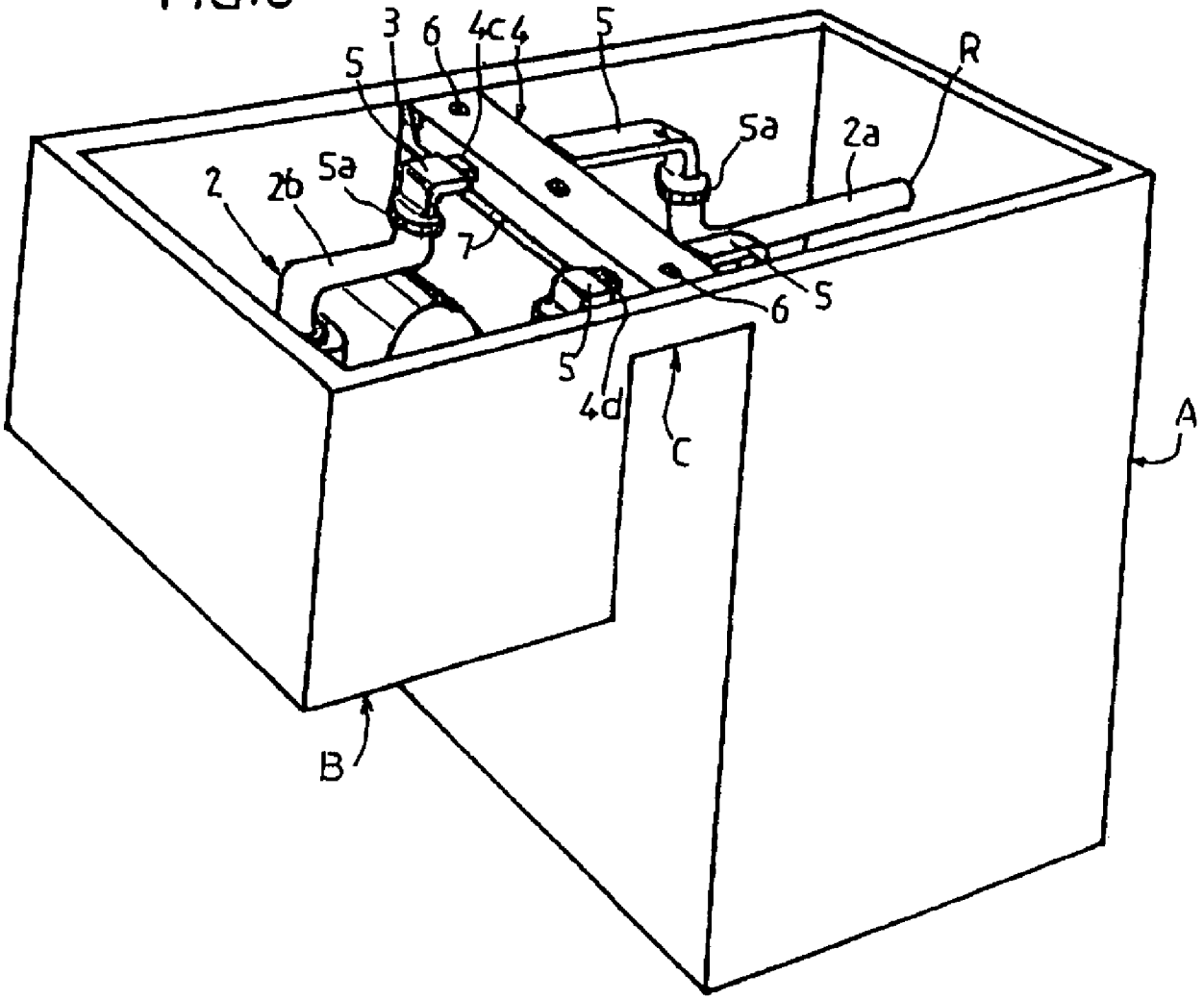
FIG. 6 is a diagrammatic perspective view of an example of the application of the connection device to a compact filtration unit.

As will be fully familiar to those skilled in the art, this type of filtration unit essentially comprises a compartment (A) submerged in the water and known as the "filtration compartment", and a compartment (B), situated on the outside of the swimming pool and generally known as the "pumping compartment". The two compartments (A) and (B) are connected together by a common connecting part (C) to form a single block. The pumping compartment (B) is usually designed to be buried in the ground.

The filtration compartment (A) comprises, as is known very well, one or more filtration means (F), which may take various forms. The pumping compartment (B) houses one or more pumps (P) for sucking the water out of the swimming pool, it having passed en route through one or more filters (F), and returning the filtered water to the swimming pool, by means of, for example, a return nozzle (R).

The swimming pool water suction and return circuit, in combination with the filtration (F) and pumping (P) means, essentially follows a suction pipe (1) connected to the pump (P) suction intake, and a return pipe (2) connected to the pump (P) return outlet. The pipes (1) and (2) are largely made up of round-section elements of the type widely sold in the trade and their diameter is determined as a function of the flowrate.

According to the invention, the problem addressed by the invention, as indicated, is how to minimize the height of the common connecting part (C) between the compartments (A) and (B), emphasizing that this common connecting part (C) usually has, either directly or by an attachment, members (3) for the watertight separation of the two compartments (A) and (B), notably in order to avoid any risk of the water filling the filtration compartment and spilling over into the pumping compartment. Such members are thoroughly familiar to those skilled in the art, as can be seen for example by the teaching of the patents cited earlier.

Given this configuration, therefore, it can be seen that the suction (1) and return (2) pipes are constructed in the form of two parts or assemblies (1*a*, 1*b*) and (2*a*, 2*b*). Part (1*a*) of the suction pipe is situated in the filtration compartment, while part (1*b*) is situated in the pumping compartment. In the same way, part (2*a*) of the return pipe is situated in the filtration compartment, while part (2*b*) is situated in the pumping compartment.

It is important therefore to connect up the two parts (1*a*) and (1*b*) on the one hand, and (2*a*) and (2*b*) on the other, as they negotiate the members (3), within the smallest height possible, as indicated.

According to the invention, the device for connecting the suction (1*a*, 1*b*) and return (2*a*, 2*b*) conduit parts has connecting members that are thinner than the diameter of the various pipe elements (1) and (2).

In a preferred embodiment, the connecting device denoted as a whole by (4) comprises a module of flat transverse section, with a thickness (e) that is less than the diameter (d) of the component elements of the pipes (1) and (2). This module is hollow and defines, in section, at least one, but preferably two internal and separate conduits (4*a*) and (4*b*). On either side of the body of the module (4), the conduits (4*a*) and (4*b*) have members (4*c*) and (4*d*) for watertight connection to the flat-section connectors (5). The connectors (5) are fixed in a watertight manner, by any appropriate known means, to the parts (1*a*) and (1*b*) of the suction pipe and to the parts (2*a*) and (2*b*) of the return pipe.

The members (4*c*) and (4*d*) of the module (4) are flat, especially rectangular, section adaptors in communication with the conduits (4*a*) and (4*b*), and on which the complementary-section connectors (5) can be engaged.

Advantageously, the flat-section connectors (5) are made integral, directly or by being connected, with round-section adaptors (5*a*) able to be connected by watertight engagement with the corresponding parts of the pipes (1*a*, 1*b*) and (2*a*, 2*b*) (FIG. 1).

The module (4) is an independent add-on element fixed in a watertight manner in the common connecting part (C) between the two compartments (A) and (B). More specifically, the module (4) has in section a profile able to fit in a complementary profile (3*a*) serving as a bearing cradle formed in the thickness of a watertight separating partition (3). It may be fixed, for example, by means of screws (6) in combination with a seal (7) placed in the bottom of the bearing cradle (3*a*).

Note that in one particular embodiment of the filtration unit, the module (4) and the two compartments (A) and (B) are connected together by a common linking frame (not shown) fitted with covers for closing each of the said compartments.

Because the connecting module (4) and the corresponding connectors (5) are so low, it is possible to minimize the height of the common linking part (C), in such a way that the complete filtration unit, once installed in a straddling position sitting on the corresponding edge of the swimming pool, rises above it by only a small height which is at the very most less than the height generally accepted when using round-section piping through the common linking part.

Clearly, the dimensions of the connecting adaptors (4*c*) and of the corresponding connectors (5) are suitable for the desired flowrate. As a guide, if using 75-mm diameter pipe elements, the connecting adaptors (4*c*) and (4*d*) and the connectors (5) may have a thickness of approximately 25 mm while pointing out that this thickness may be further reduced if the width is increased in order to give an equivalent cross section so as to suite the flowrate.

The advantages will be obvious from the description.

The invention claimed is:

1. Device for connecting pipe parts between two compartments of a filtration unit for water of a swimming pool, the filtration unit comprising a filtration compartment submerged in the water and equipped with at least one filtration means and a pumping compartment situated outside of the swimming pool and equipped with at least one suction and return pump, the compartments being connected by a common connecting part that straddles walls of the swimming pool, the at least one filtration means and at least one pump being connected in combination with suction pipe parts and return pipe parts, the suction pipe parts and the return pipe parts each comprising one conduit part situated in the filtration compartment and one conduit part situated in the pumping compartment, and further comprising, at the common connecting part, a watertight connecting module between the suction pipe parts and between the return pipe parts, wherein the module has a thin flat cross section and defines in section, two separate internal conduits, each conduit having a thin flat cross section and a pair of opposed thin flat connection members for water tight connection with corresponding flat-section connectors, the connectors being fixed to the conduit parts of the suction and return pipes positioned in the filtration and pumping compartments, at the common connecting part.

2. Device according to claim 1, wherein the flat-section connectors are made integral, directly or by being connected, with round-section adaptors able to be connected by watertight engagement with the pipe parts.

3. Device according to claim 1, wherein the module comprises an independent add-on element fixed in a watertight manner to the common connecting part, between the two compartments.

4. Device according to claim 3, wherein the module has in section a profile able to fit in a complementary profile serving as a bearing cradle formed in a thickness of a separating plate belonging to the common connecting part.

5. Device according to claim 1, wherein the module and the two compartments are connected together by a common linking frame fitted with covers for closing each of said compartments.

6. Device according to claim 1, wherein the internal conduits have a rectangular cross section.

* * * * *